US005971669A

United States Patent [19]

Crigler

[11] Patent Number: 5,971,669

[45] Date of Patent: Oct. 26, 1999

[54] MECHNICALLY STABILIZED RETAINING WALL SYSTEM HAVING ADJUSTABLE CONNECTION MEANS FOR CONNECTING PRECAST CONCRETE FACING PANELS THERETO

[75] Inventor: John Richard Crigler, Raleigh, N.C.

[73] Assignee: L.B. Foster Company, Pittsburgh, Pa.

[21] Appl. No.: 09/079,715

[22] Filed: May 15, 1998

[51] Int. Cl.[6] ..... E02D 3/02

[52] U.S. Cl. ..... 405/284; 405/262; 405/286; 403/43

[58] Field of Search ..... 465/284, 262, 465/285, 286, 287; 52/231, 234, 222, 506.6; 403/43, 44, 48

[56] References Cited

U.S. PATENT DOCUMENTS

| | | | |
|---|---|---|---|
| 145,116 | 12/1873 | McKierman | 403/44 |
| 1,226,830 | 5/1917 | Walker | 403/44 |
| 1,876,720 | 9/1932 | Merrill | 403/43 X |
| 1,879,636 | 9/1932 | Cole | 403/48 X |
| 3,743,330 | 7/1973 | Itatani | 403/44 |
| 3,802,205 | 4/1974 | Dickinson | 405/285 |
| 4,329,089 | 5/1982 | Hilfiker et al. | 405/262 |
| 4,725,170 | 2/1988 | Davis | 405/258 |
| 4,961,673 | 10/1990 | Pagano et al. | 405/287 |
| 5,002,436 | 3/1991 | Sigourney | 405/262 |
| 5,259,704 | 11/1993 | Orgorchock | 405/262 |
| 5,305,573 | 4/1994 | Bauman | 403/43 X |
| 5,395,370 | 3/1995 | Muller et al. | 403/44 X |
| 5,451,120 | 9/1995 | Martinez-Gonzalez | 405/262 |
| 5,494,379 | 2/1996 | Anderson et al. | 405/262 |
| 5,531,547 | 7/1996 | Shimada | 405/262 |
| 5,577,866 | 11/1996 | Anderson et al. | 405/284 |
| 5,622,455 | 4/1997 | Anderson et al. | 405/262 |
| 5,669,737 | 9/1997 | Equilbec et al. | 405/262 |
| 5,730,559 | 3/1998 | Anderson et al. | 405/284 |
| 5,749,680 | 5/1998 | Hilfiker et al. | 405/262 |

*Primary Examiner*—William Neuder
*Assistant Examiner*—Jong-Suk Lee
*Attorney, Agent, or Firm*—Jenkins & Wilson, P.A.

[57] ABSTRACT

A retained earth structure includes an upright soil retaining wall of interlocking facing panels and a plurality of horizontal elongated wire mesh reinforcement panels extending outwardly from the back surface of the modules into the backfill material. The wire mesh panels are connected in tiers to the retaining wall while embedded in the backfill material soil behind the wall by use of a three-way adjustable, turnbuckle-type connector assembly. The three-way adjustable turnbuckle-type connector assembly ensures verticality of the finished precast wall panels.

21 Claims, 6 Drawing Sheets

MECHNICALLY STABILIZED RETAINING WALL SYSTEM HAVING ADJUSTABLE CONNECTION MEANS FOR CONNECTING PRECAST CONCRETE FACING PANELS THERETO

FIELD OF THE INVENTION

The present invention relates to retained earth structures in general and in particular to a retained earth structure comprising a plurality of interlocked facing modules that are adjustably connected to elongated wire mesh reinforcing panels buried in backfill material behind the wall modules by means of a novel adjustable turnbuckle-type connector assembly.

RELATED ART

As is well known to those skilled in the art, retained earth structures are constructed of a wall for retaining earth and backfill material placed behind the wall. Elongated elements such as wire mesh panels or soil spikes extend from various locations on the back surface of the wall into the interior of the backfill material and thereby prevent the wall from buckling outwardly and/or collapsing. Typically, a metal connector assembly is used to connect the elongated members to the back surface of the wall.

The wall can be formed in different ways. For example, the wall may consist of a uniform, unbroken expanse of concrete or the like which is poured on site. Further, the wall may comprise a plurality of interlocking precast concrete modules or wall members which are assembled into interlocking relationship on the site.

The use of precast modules tends to be less expensive than on-site poured concrete since the installation and removal of the forms required when concrete is poured on site as well as the transportation to and pouring of large amounts of concrete on site are generally not required. Further, the amount of labor required for assembling the precast modules is generally less than that required for poured concrete walls. Typically, the elongated members used to prevent the outward buckling of the wall in retained earth structures comprises elongated straps of material having a generally rectangular cross-section. Outward movement of the wall and the straps for the backfill material is prevented by means of friction between the backfill material and the straps extending into the backfill material.

A number of methods and apparatus are known to those skilled in the art for attaching the strap members to individual wall modules or to on site poured concrete walls. By way of example, U.S. Pat. No. 3,686,873 discloses a number of structures comprising a plurality of individual strap members that are attached to a plurality of wall modules. In one structure, one or more U-shaped members having widely spaced legs are anchored in each one of the wall modules. The ends of each leg of each U-shaped member extend beyond the back surface of the module, and a bolt-and-nut assembly is used to attach one end of each strap member to the ends of the legs of each of the U-shaped members. In another one of the structures disclosed in the patent, one or more ring-shaped members are anchored in each of the modules and one end of each strap member is passed through the ring-shaped member folded back on itself and bolted or riveted to an underlying section thereof. In another structure disclosed in the patent, the end of each strap member is attached to the modules by passing a rod or pin used for interlocking the modules together through a hole provided therefore in the end of the strap member.

Also of interest, U.S. Pat. No. 4,449,857 discloses a structure comprising a plurality of elongated wire mesh panels which are attached to a plurality of wall modules by means of threaded female fittings anchored in the wall modules and threaded male fittings moveably mounted to the end of each elongated wire in the wire mesh panel. In each panel there is provided a plurality of lengthwise extending parallel wires which are spaced about six inches apart and interconnected by cross bars welded perpendicularly to the wires at spaced intervals.

The advantage that elongated wire mesh reinforcement panels have over the straps described above is that, in addition to friction forces, outward movement of the panels and the wall modules attached thereto is further restrained by the cross bars which engage the backfill material bearing downwardly thereon. Disadvantages of prior known wire mesh reinforcement panel structures are that the threaded male and female fittings used for attaching the wire mesh panels to the wall modules are relatively expensive to make, and the threading of the fixtures together during installation is time consuming. Moreover, the strength of each attachment is limited by the small length of the enlarged protuberance located at the end of each wire in the wire mesh panel structure for retaining the male part of the fitting.

The limitations of the prior art were addressed by U.S. Pat. No. 4,725,170 (assigned to the assignee of the present invention) wherein a soil retaining system is disclosed comprising an upright wall of modular facing panels and a number of horizontal wire mesh reinforcement panels that include spaced parallel wires ending in a loop and the parallel wires being interconnected by perpendicular cross bars along the length of the mesh panel. The mesh panels are connected to the modular wall panels by means of connecting each parallel wire loop in a mesh panel to a clevis embedded into the backside of a wall panel with a bolt-and-nut assembly or an elongated pin member. The novel clevis and bolt assembly disclosed in the patent provides an advantage since conventional materials are used for forming the clevis and elongated mesh panel members and the means for attaching the mesh panels to the devises is relatively quick, easy, and inexpensive. However, shortcomings have been discovered in the practice of the invention in view of limitations in the adjustability of the clevis connector assemblies between an elongated wire mesh panel and an associated wall module. Thus, there is a long-felt need for a easily adjustable connector assembly for connecting elongated wire mesh panels and interlocking wall modules in a mechanically stabilized earth system.

DISCLOSURE OF THE INVENTION

In accordance with the present invention, applicant provides a mechanically stabilized retaining wall system with a novel adjustable connection assembly for connecting precast concrete facing panels of an upright retaining wall to elongated wire mesh panels extending rearwardly from the wall and into the interior of backfill material placed behind the wall. The retained earth structure comprises an upright retaining wall formed from a plurality of interlocked facing modules for retaining backfill material placed behind the wall wherein the facing modules each include at least one connector element anchored therein and extending outwardly from the back surface thereof. A plurality of elongated wire mesh panels are provided which extend rearwardly from the retaining wall into the interior of the backfill material therebehind wherein the wire mesh panels each define an interior end and an exterior end and each comprises a plurality of lengthwise extending wires having apertures formed at the exterior ends thereof. A plurality of elongate universally adjustable connection means are provided for adjustably connecting the wire mesh panels to the interlocked facing modules by connecting them with respective ends of the plurality of adjustable connection means. The connection means are adapted for being adjustable horizontally, vertically, and in length relative to the upright retaining wall.

Also, in accordance with the present invention, a method of constructing a mechanically stabilized retaining wall system is provided that utilizes precast concrete facing panels. The method comprises setting the precast concrete facing panels into place beginning with the bottommost panels and installing a plurality of spaced wire mesh reinforcement panels behind the concrete facing panels and embedding the plurality of wire mesh panels as soil is placed and compacted behind the concrete facing panels. Next, a plurality of adjustable turnbuckle-type connector elements for adjustably connecting the wire mesh panels to the concrete facing panels are provided and secured therebetween at fastener elements on the back of the concrete facing panels and at the outer end of the wire mesh panels so that the turnbuckle-type connector elements are individually adjustable horizontally, vertically, and in length relative to the retaining wall for an optimal connection.

It is therefore the object of the present invention to provide an improved mechanically stabilized earth (MSE) retaining wall system incorporating a novel adjustable connection means for connecting precast concrete facing panels to elongated wire mesh panels extending rearwardly therefrom into the interior of backfill material.

It is another object of the present invention to provide a novel adjustable connection means between an upright retaining wall formed from a plurality of interlocked facing modules and a plurality of elongated wire mesh panels extending rearwardly therefrom into the interior of backfill material placed behind the wall wherein the adjustable connection means is adapted to move horizontally, vertically, and in length relative to the upright retaining wall in order to provide greater ease of properly connecting the elongated wire mesh panels to the interlocking modules of the upright retaining wall.

Some of the objects of the invention having been stated hereinabove, other objects will become evident as the description proceeds, when taken in connection with the accompanying drawings as best described hereinbelow.

BEST MODE FOR CARRYING OUT THE INVENTION

As known to those skilled in the art, a mechanically stabilized earth (MSE) retaining wall system is a retaining wall that is essentially installed from the bottom up. Panels (such as precast concrete panels) are first set in place starting with the bottommost panels of a desired retaining wall. Steel reinforcing mats are attached to the back of panels with a suitable connector device, and soil is then placed and compacted behind the facing panels so as to embed the steel reinforcing mats and raise the soil level behind the precast concrete panels. Layers of the steel reinforcing mats are placed at predetermined intervals along the length of the wall, and more facing panels are then added to the bottommost panels and connected to the new layer of steel reinforcing mats. This conventional process is then repeated until the desired height of the wall is reached. Thus, there will be laterally spaced-apart and vertically spaced-apart steel reinforcing mats (wire mesh panels) extending from the face of the upright retaining wall formed from a plurality of interlocked facing modules (including but not limited to precast concrete panels) that are connected together by suitable connector devices. Typically, a wire mesh wall is constructed over the face of the backfill material soil for better retention thereof during the construction of the retained earth structure.

Figure 1:
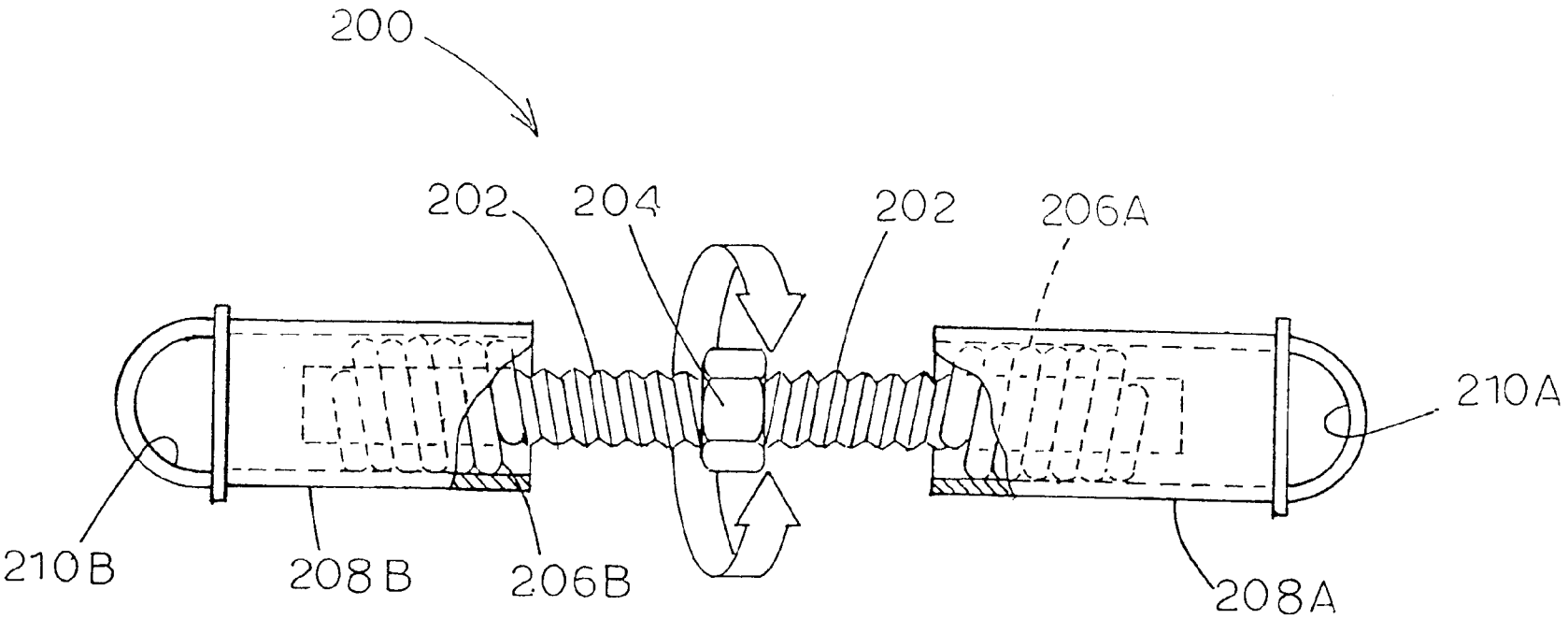
FIG. 1 is a side elevation view of the adjustable connector of the present invention used to connect an upright retaining wall structure formed from a plurality of interlocked facing modules to a plurality of elongated wire mesh panels extending rearwardly from the upright wall into the interior of backfill material placed therebehind.
Figure 2:
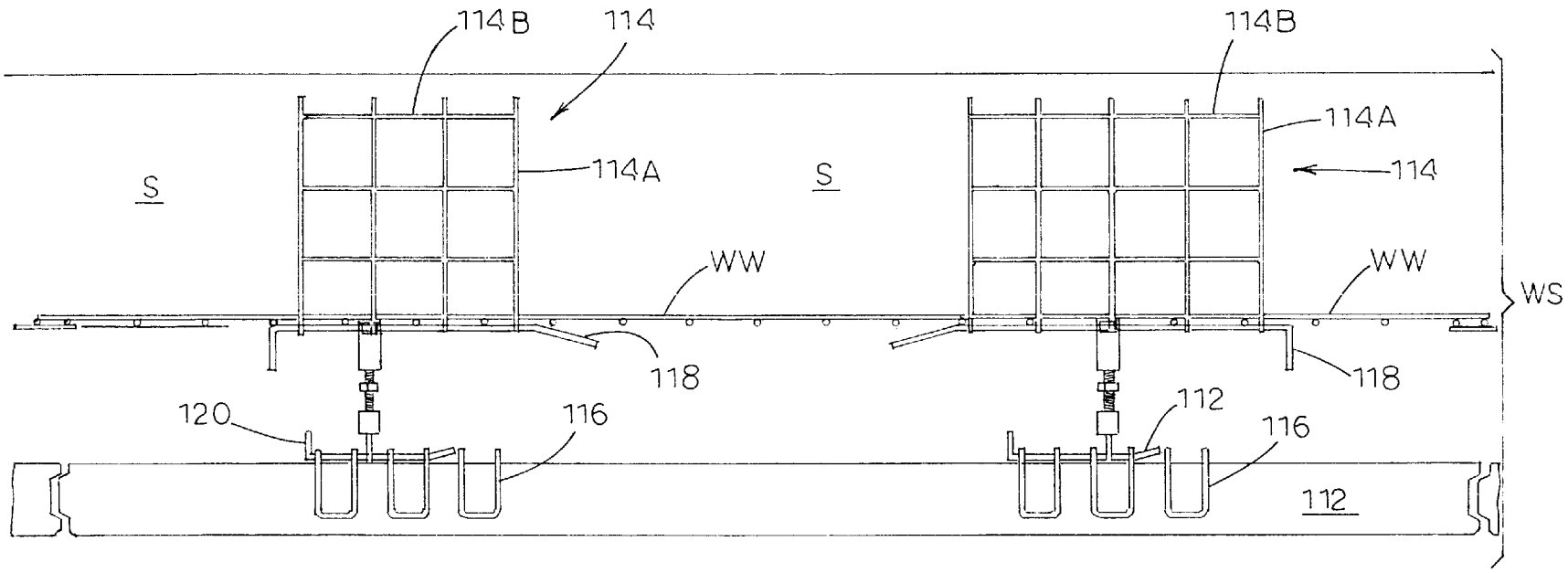
FIG. 2 is a top plan view of a retained earth structure formed with the adjustable connectors of the present invention.
Figure 3:
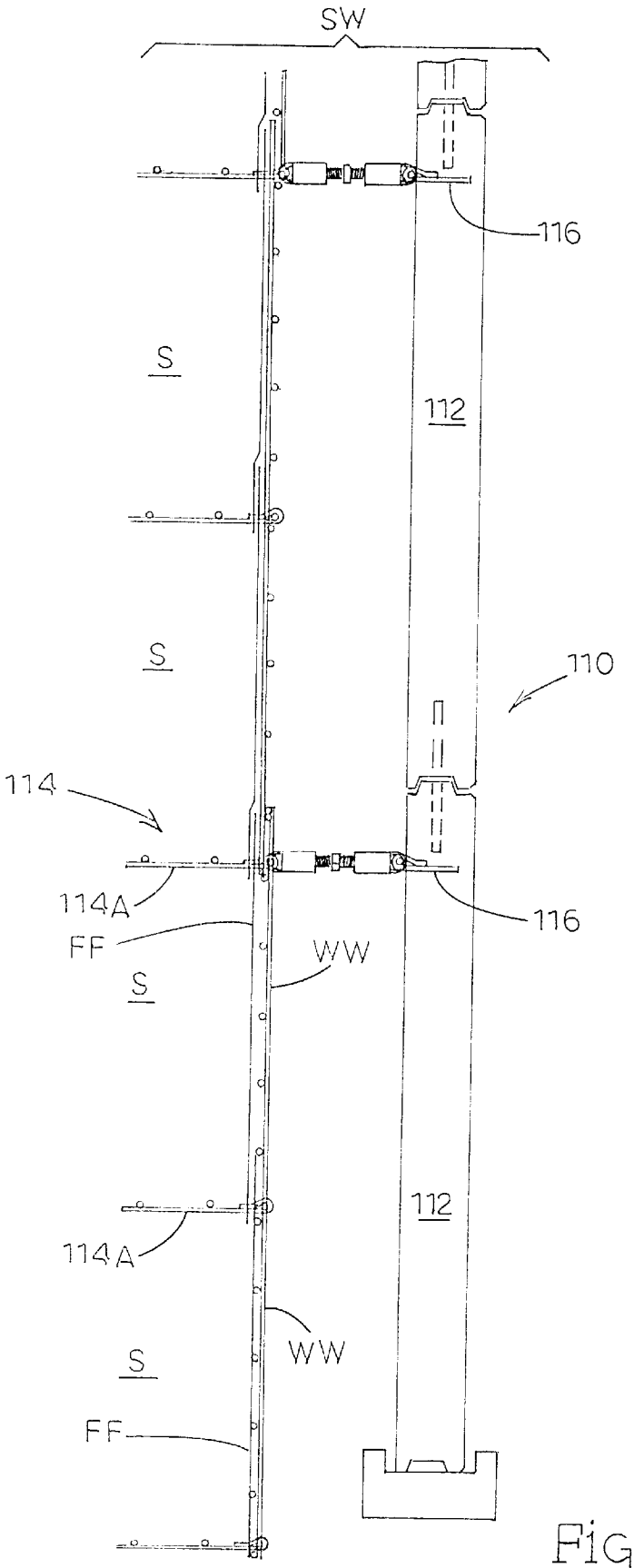
FIG. 3 is a vertical cross-sectional view of a retained earth structure formed with the adjustable connector of the present invention.

Referring now to FIGS. 1 through 4 of the drawings, applicants' invention will be described in detail hereinafter. Referring first particularly to FIGS. 2 and 3 of the drawings, a retained earth retaining wall system is illustrated in accordance with the present invention and generally designated WS. Retained earth wall system WS includes an upright, typically vertical retaining wall, generally designated by the number 110, most suitably formed of interlocked modular facing modules or wall panels 112 (e.g., precast concrete panels). Extending from the back surface of wall panels 112 in a generally horizontal direction are elongated wire mesh soil reinforcement panels 114 that are embedded into the backfill material soil designated S. Mesh reinforcement panel 114 includes a plurality (generally 4 to 6) of generally parallel and lengthwise extending spaced-apart metal wires 114A interconnected by generally parallel spaced-apart crossbars 114B by welding or the like at crossover points. Crossbars 114B are positioned generally perpendicular to lengthwise extending wires 114A. Preferably, the surface of backfill material soil S is stabilized by a wire wall structure WW and optional filter fabric FF.

Figure 4A:
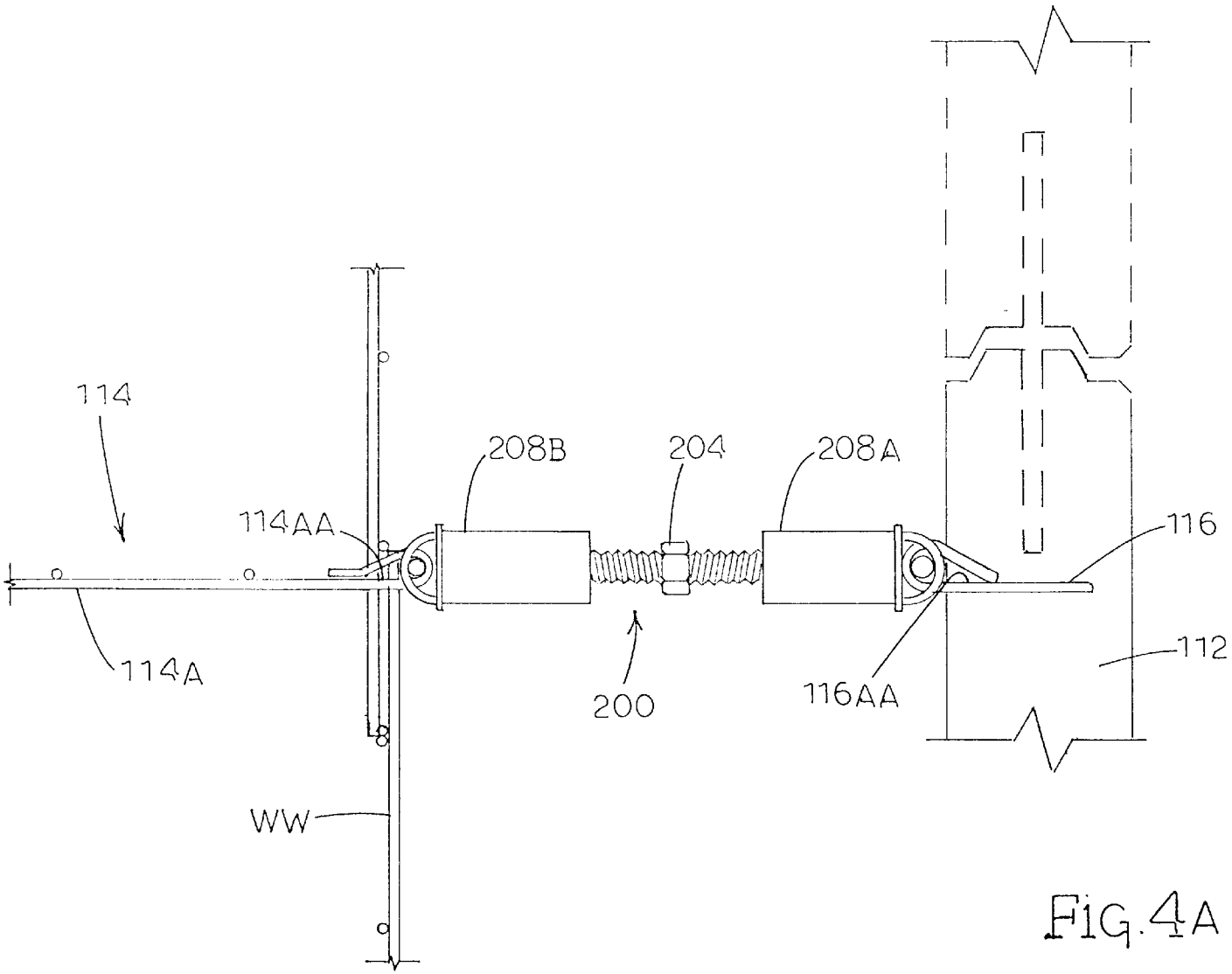
FIGS. 4A, 4B and 4C depict the connector element of the present invention extending between an upright retaining wall facing module and an associated elongated wire mesh panel in a retracted position, a raised and extended position, a lowered and extended position, respectively.
Figure 4B:
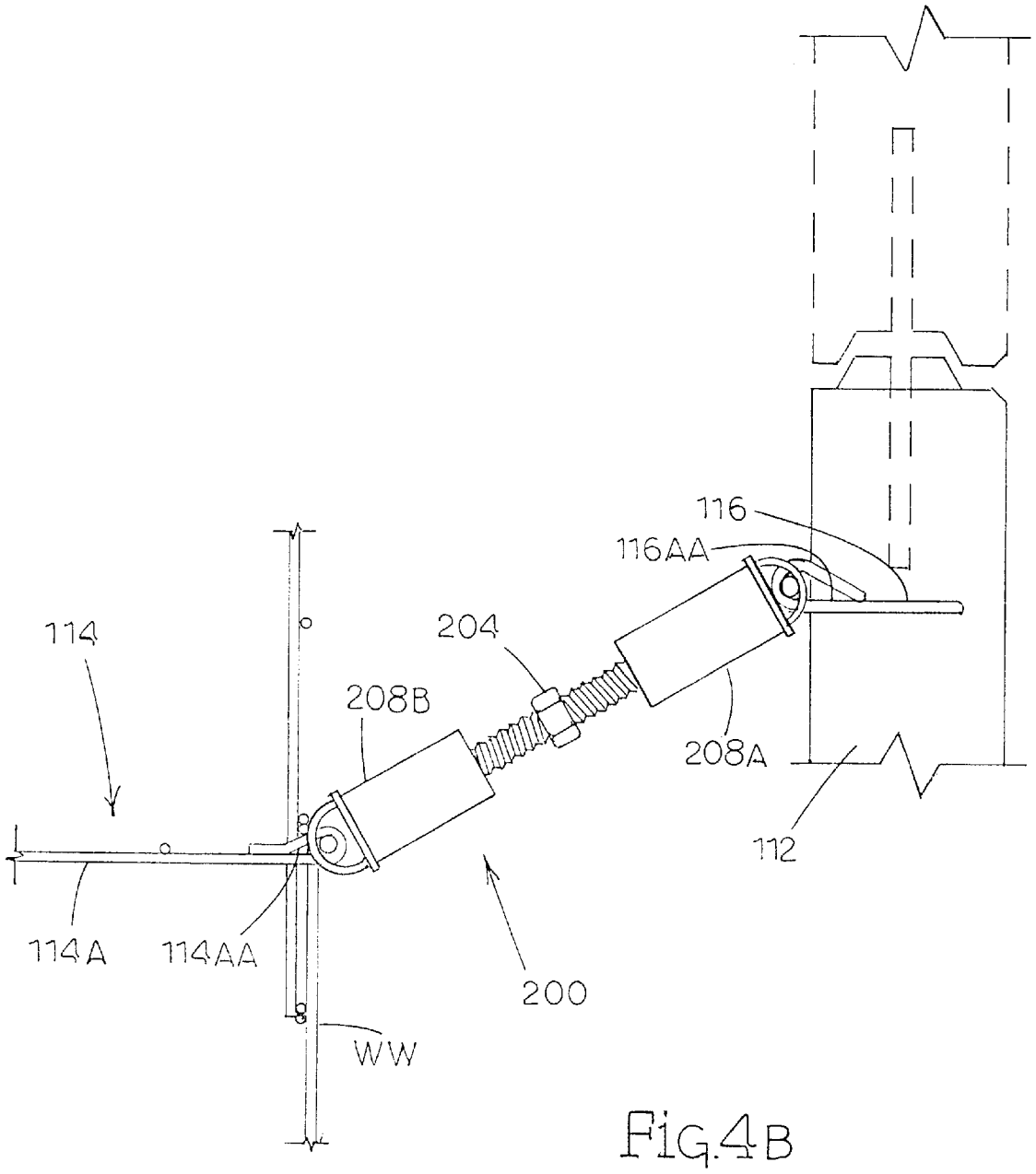
Figure 4C:
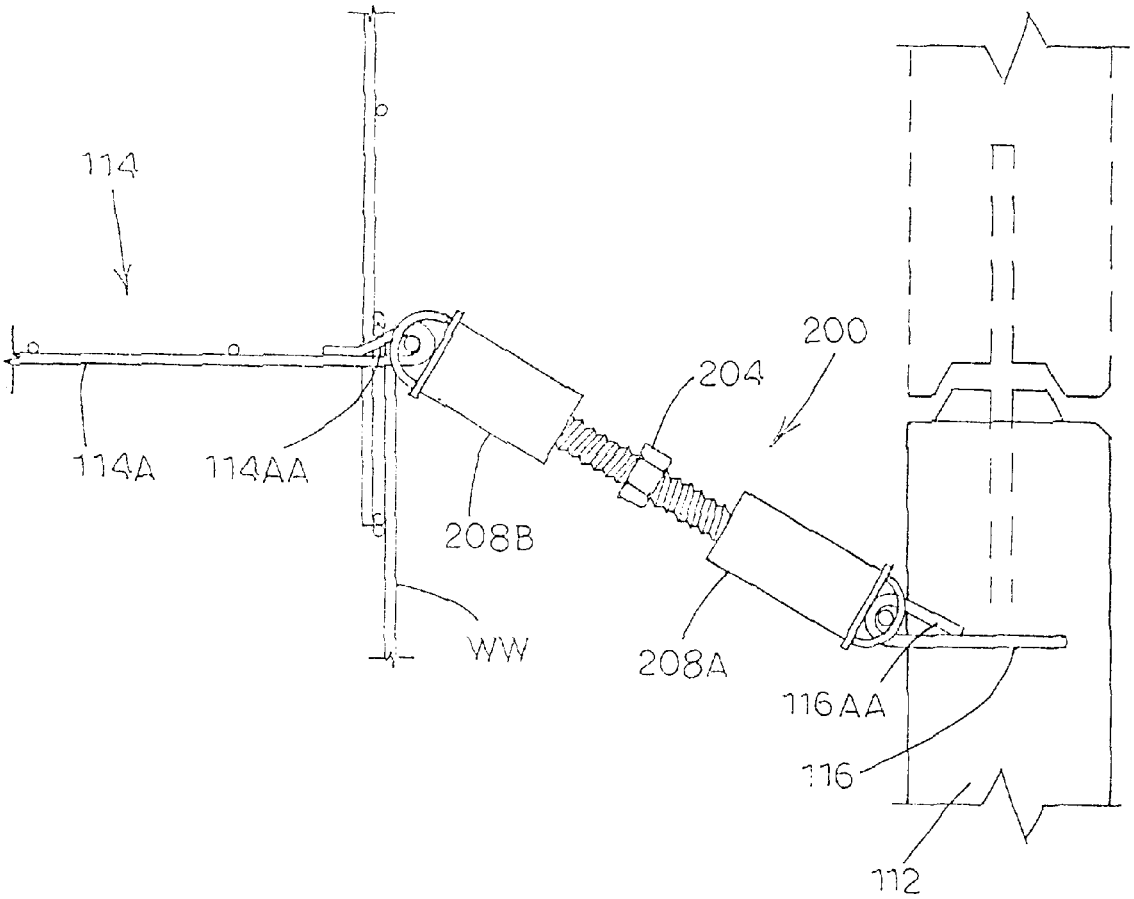

Referring particularly to FIGS. 4A–4C, it can be understood that one end of each of the lengthwise extending wires 114A of elongated mesh soil reinforcement panels 114 terminate at the exterior end of the mesh As will be understood with reference to the description herein, wire mesh soil reinforcement panels 114 are attached to soil retaining wall facing panels 112 in spaced horizontal layers from the bottom of the retaining wall to the top with soil being layered above the lowermost soil reinforcement panel 114 to a higher level at which the next unit is attached to retaining wall 110. In this manner, mesh reinforcement panels 114 are embedded into soil S. The use of wire mesh panels 114 in a retained earth wall system is conventional and known in the art.

Also, applicants note that it is known to utilize devises formed in the precast concrete wall panels 112 to facilitate securement of a connector between precast wall panel 112 and wire mesh soil reinforcement panels 114 to prevent buckling of the upright retaining wall. Representative connectors are shown in U.S. Pat. No. 4,725,170 and U.S. Pat. No. 5,002,436, and the disclosure of both patent references is incorporated herein by reference thereto. To applicants' best knowledge, however, previously utilized connectors between wire mesh soil reinforcement panels 114 and precast interlocking wall panels 112 have been clevis-and-bolt type or similar non-adjustable connector systems. Thus, a main feature of the novel retaining wall system of the present invention is the provision of an adjustable connector member 200 between retaining wall facing panels 112 and mesh soil reinforcement panels 114 that is adjustable horizontally, vertically, and in length to facilitate ease of connection and correct adjustment of the connector extending between wire mesh soil reinforcement panels 114 and precast wall panels 112 to better prevent buckling of retaining wall 110. The details of the improved mechanically stabilized retaining wall system WS will be described in detail hereinafter.

Referring now particularly to FIGS. 4A–4C, connector assembly 200 is utilized to connect retaining wall interlocking precast panels 112 to wire mesh soil reinforcement panels 114. The upright retaining wall (see FIGS. 2 and 3) is formed with a plurality of U-shaped devises 116 cast into individual interlocking precast concrete panels 112 such that a portion of the legs of each clevis extends beyond the back surface of precast concrete panel 112. Clevises 116 are shown as a cluster of three laterally spaced devises 116 in each precast concrete panel 112 wherein the ends of the legs are turned back upon themselves (see FIGS. 4A–4C) to form an aperture 116AA at the end of each leg. One end of connector assembly 200 is connected to devises 116 by inserting connection, or connector/fastener element pin 120 through the apertures at the end of one or more of the cluster of devises 116 and through one end of connector assembly 200 (see FIG. 2) to be described in more detail hereinafter.

Although the drawings show a cluster of three laterally spaced-apart devises 116 mounted in each interlocking precast concrete panel 112, it should be appreciated by one skilled in the art that any number or arrangement of devises 116 can be incorporated into each precast module or panel 112 in order to provide for connection of one end of connector assembly 200 to precast concrete panel 112, the configuration and number of devises 116 being a matter of design choice. For example, for many full-sized precast concrete modules 112, there may be two rows of devises 116 provided in each module, and for half-size modules there may be one row of devises 116 provided in precast concrete modules 112. Further, it may be sufficient in some applications, particularly in the upper portions of a retaining wall, for alternate precast wall panels 112 to be anchored to wire mesh panels 114 if the interlocking features of precast wall panels 112 are sufficiently strong to withstand the forces tending to buckle a retaining wall formed of panels 112 outwardly. The plurality of wire mesh panels 114 extending outwardly from the back surface of wall panels 112 into interior or backfill material are formed of the aforementioned lengthwise extending wires 114A that each define aperture 114AA therein. Thus, in order to secure the other end of connector assembly 200 shown in FIG. 1 to wire mesh panels 114, mesh pin 118 is inserted through apertures 114AA across the face of mesh panel 114 and the end of connector assembly 200 that is not connected to retaining wall panel 112. In the aforementioned fashion, both ends of connector assembly 200 have been connected to a respective retaining wall panel 114 at one end and a respective wire mesh panel 114 at the other end extending into the interior of backfill material that has been placed behind the retaining wall.

Now, applicants refer to FIG. 1 to describe adjustable connector assembly 200 incorporated to construct the novel retained earth wall structure WS of the invention. Adjustable connector assembly 200 comprises a coil bolt 202 having a nut 204 in the medial portion thereof and a right hand thread on the right side of coil bolt 202 and a left side thread on the left side of coil bolt 202. Matching coil nuts 206A and 206B are retained in respective housings 208A and 208B, respectively. Coil nut 206B is internally threaded to threadingly receive the left hand threaded side of coil bolt 202, and coil nut 206B is internally threaded to threadingly receive the right hand threaded side of coil bolt 202 in order to create a "turnbuckle" device allowing for extension or retraction of the length of connector assembly 200. Further, connector assembly 200 includes looped ends so as to define apertures 210A and 210B at opposing ends of connector assembly 200. Thus, with particular reference to FIGS. 4A–4C it can be appreciated that connector assembly 200 is adjustable to allow for adjustments in either of three directions to properly connect precast concrete panels 112 to previously installed wire mesh reinforcement panels 114 extending into the backfill material behind the upstanding retaining wall. Connector assembly 200 can be adjusted in or out by rotating nut 204 of coil bolt 202 clockwise or counterclockwise (see FIG. 4A). Also, connector assembly 200 can also be tilted up (see FIG. 4B) or tilted down (see FIG. 4C) or adjusted horizontally along the width of the retaining wall to assure verticality of the finished upright retaining wall formed from precast wall panels 112 even if wire wall mesh panels 114 in the face of the backfill material soil S is misaligned.

A number of modifications of the present invention may be made without departing from the scope of the invention. For example, while applicant describes a preferred embodiment of the invention wherein precast concrete panels 112 are utilized, it should be understood that other types of interlocking facing modules may be utilized in the construction of an upright retaining wall or backfill material and are intended to be within the scope of the invention. Furthermore, the number, spacing and construction material of elongated mesh reinforcement panels 114 may be modified depending on the characteristics desired for the retained earth structure.

It is apparent from the foregoing detail description that applicants have provided a unique adjustable connector assembly for interlocking wall panels of a modular soil retaining wall with elongated wire mesh reinforcement panel which has unique advantages of ease of adjustment of the connection therebetween by providing for horizontal, vertical, and length adjustment relative to the face of the upright retaining wall to ensure verticality of the finished precast wall panels.

It will be understood that various details of the invention may be changed without departing from the scope of the invention. Furthermore, the foregoing description is for the purpose of illustration only, and not for the purpose of limitation—the invention being defined by the claims.

What is claimed is:

1. A retained earth structure comprising:

(a) a retaining wall extending upwardly from a ground level and formed from a plurality of interlocked facing modules for retaining backfill material placed behind said wall, said facing modules each comprising at least one connector element anchored therein, each connector element including a leg having an end region extending outwardly from the back surface of said module, the end region of each leg having an aperture adapted to receive an elongate member having a longitudinal axis oriented substantially parallel to the ground level;

(b) a plurality of elongated wire mesh panels adapted to extend rearwardly from said wall into the interior of said backfill material, said wire mesh panels each defining an interior end and an exterior end and each comprising a plurality of lengthwise extending wires having a plurality of apertures formed at the exterior ends thereof; and (c) a plurality of elongate adjustable connection means for adjustably connecting said wire mesh panels to said interlocked facing modules by engaging the elongate member of one or more selected connector elements of a facing module at one end thereof and one or more selected wire apertures of a wire mesh panel at the other end thereof, said adjustable connection means each being adjustable horizontally, vertically, and in length relative to said retaining wall.

2. The structure according to claim 1 wherein each of said facing modules includes a plurality of connector elements anchored therein.

3. The structure according to claim 2 wherein said connector elements each comprises a U-shaped clevis with a pair of parallel legs extending a predetermined distance beyond the back surface of an associated module, and wherein each of said legs defines an aperture at the end thereof adapted to receive the elongate member.

4. The structure according to claim 1 wherein said wire mesh panels comprise said plurality of lengthwise extending wires and a plurality of spaced cross wires rigidly attached to said lengthwise extending wires so as to define interstices that said backfill material can engage.

5. The structure according to claim 1 including an elongate pin that extends through one end of one or more adjustable connection means and one or more wire apertures of said wire mesh panel.

6. The structure according to claim 1 wherein said adjustable connection means comprises:

(a) a two-part housing comprising a first cylindrical housing defining an open end and a closed end, and a second spaced-apart cylindrical housing defining an open end and a closed end;

(b) an elongate coil bolt with a nut element in the medial portion thereof and defining a right hand coil thread on one side of said nut element and a left hand coil thread on the other side of said nut element, said elongate coil bolt extending onto the open end of said first cylindrical housing at one end thereof and onto the open end of said second cylindrical housing at the other end thereof; and (c) a right hand coil nut mounted in said first cylindrical housing for threadably receiving said right hand coil thread of said elongate coil bolt and a left hand coil nut mounted in said second cylindrical housing for threadably receiving said left hand coil thread of said elongate coil bolt;

whereby said adjustable connection means acts as a turnbuckle when said nut element of said elongate coil bolt is adjusted.

7. The structure according to claim 6 wherein said adjustable connection means comprises an aperture at each opposing end thereof for engaging one or more facing module connector elements at one end and one or more mesh panel wire apertures at the other end thereof.

8. A retained earth structure comprising:

(a) a retaining wall extending upwardly from a ground level and formed from a plurality of interlocked facing modules for retaining backfill material placed behind said wall, said facing modules each comprising a plurality of connector elements anchored therein, each connector element including a leg having an end region extending outwardly from the back surface of said module, the end region of each leg having an aperture adapted to receive an elongate member having a longitudinal axis oriented substantially parallel to the ground level;

(b) a plurality of elongated wire mesh panels adapted to extend rearwardly from said wall into the interior of said backfill material, said wire mesh panels each defining an interior end and an exterior end and each comprising a plurality of spaced widthwise wires and spaced lengthwise wires, and wherein said lengthwise extending wires have a plurality of apertures formed at the exterior ends thereof; and (c) a plurality of elongate adjustable connection means for adjustably connecting said wire mesh panels to said interlocked facing modules by engaging the elongate members of said connector elements of a facing module at one end thereof and a plurality of wire apertures of a wire mesh panel at the other end thereof, said adjustable connection means each being adjustable horizontally, vertically, and in length relative to said retaining wall.

9. The structure according to claim 8 wherein said connector elements each comprises a U-shaped clevis with a pair of parallel legs extending a predetermined distance beyond the back surface of an associated module, and wherein each of said legs defines an aperture at the end thereof adapted to receive the elongate members.

10. The structure according to claim 8 including an elongate pin that extends through one end of one or more adjustable connection means and said plurality of wire apertures of said wire mesh panel.

11. The structure according to claim 8 wherein said adjustable connection means comprises:

(a) a two-part housing comprising a first cylindrical housing defining an open end and a closed end, and a second spaced-apart cylindrical housing defining an open end and a closed end;

(b) an elongate coil bolt with a nut element in the medial portion thereof and defining a right hand coil thread on one side of said nut element and a left hand coil thread on the other side of said nut element, said elongate coil bolt extending into the open end of said first cylindrical housing at one end thereof and into the open end of said second cylindrical housing at the other end thereof; and (c) a right hand coil nut mounted in said first cylindrical housing for threadably receiving said right hand coil thread of said elongate coil bolt and a left hand coil nut mounted in said second cylindrical housing for threadably receiving said left hand coil thread of said elongate coil bolt;

whereby said adjustable connection means acts as a turnbuckle when said nut element of said elongate coil bolt is adjusted.

12. The structure according to claim 11 wherein said adjustable connection means comprises an aperture at each opposing end thereof for engaging a plurality of said facing module connector elements at one end and a plurality of said mesh panel wire apertures at the other end thereof.

13. A method for constructing a mechanically stabilized retaining wall utilizing precast concrete facing panels extending upwardly from a horizontal plane including the steps of setting the panels in place beginning with the bottommost panels, attaching a plurality of spaced wire mesh panels to the back of said concrete facing panels, and embedding said plurality of wire mesh panels as soil is placed and compacted behind said concrete facing panels, the improvement comprising the steps of:

(a) providing a plurality of fastener elements extending from the back of said concrete facing panels, each fastener element including a leg having an end region, the end region having an aperture adapted to receive a pin having a longitudinal axis oriented substantially parallel to the horizontal plane; and (b) providing a plurality of adjustable connector members adjustably connecting said wire mesh panels to said concrete facing panels at the pin and at the outer ends of said wire mesh panels so that said connector elements are adjustable horizontally, vertically, and in length relative to said retaining wall.

14. The method according to claim 13 wherein the step of providing a plurality of adjustable connector members includes providing each connector member with:

(a) a two-part housing comprising a first cylindrical housing defining an open end and a closed end, and a second spaced-apart cylindrical housing defining an open and a closed end;

(b) an elongate coil bolt with a nut element in the medial portion thereof and defining a right hand coil thread on one side of said nut element and a left hand coil thread on the other side of said nut element, said elongate coil bolt extending into the open end of said first cylindrical housing at one end thereof and into the open end of said second cylindrical housing at the other end thereof; and (c) a right hand coil nut mounted in said first cylindrical housing for threadably receiving said right hand coil thread of said elongate coil bot and a left hand coil nut mounted in said second cylindrical housing for threadably receiving said left hand coil thread of said elongate coil bolt.

15. A retained earth structure comprising:

(a) an upright retaining wall formed from a plurality of interlocked modules for retaining backfill material placed behind the wall, each module including at least one U-shaped clevis anchored therein, the clevis having pair of parallel legs extending outwardly from the back surface of the module, each leg defining an aperture;

(b) a plurality of elongated wire mesh panels extending rearwardly from the wall into an interior of the backfill material, each wire mesh panel defining an interior end and an exterior end and including a plurality of lengthwise extending wires having apertures formed at the exterior end; and (c) a plurality of elongate connection means for adjustably connecting the wire mesh panels to the modules by engaging one or more selected clevises at one end of the connection means with a pin extending through the apertures of the legs of the clevises, and by engaging the apertures of one or more selected wire mesh panels at the other end of the connection means, each connection means being adjustable horizontally, vertically and in length relative to the wall.

16. A retained earth structure comprising:

(a) an upright retaining wall formed from a plurality of modules for retaining backfill material placed behind the wall, each module including at least one connector element anchored therein and extending outwardly from a back surface of the module;

(b) a plurality of wire mesh panels extending rearwardly from the wall into an interior of the backfill material, each wire mesh panel defining an interior end and an exterior end and including a plurality of lengthwise extending wires having apertures formed at the exterior ends; and (c) a plurality of elongate connection means for adjustably connecting the wire mesh panels to the modules by engaging one or more selected connector elements at one end of the connection means and by engaging the apertures of one or more selected wire mesh panels at another end of the connection means, each connection means being adjustable horizontally, vertically and in length relative to the wall and including:

(i) a two-part housing comprising a first cylindrical housing defining an open end and a closed end, and a second spaced-apart cylindrical housing defining an open end and a closed end;

(ii) an elongate coil bolt with an adjustable nut element in a medial portion thereof and defining a right hand coil thread on one side of the nut element and a left hand coil thread on the other side of the nut element, the elongate coil bolt extending into the open end of the first cylindrical housing at one end thereof and into the open end of the second cylindrical housing at the other end thereof; and (iii) a right hand coil nut mounted in said first cylindrical housing for threadably receiving the right hand coil thread of the elongate coil bolt and a left hand coil nut mounted in the second cylindrical housing for threadably receiving the left hand coil thread of the elongate coil bolt.

17. A retained earth structure comprising:

(a) an upright retaining wall formed from a plurality of modules for retaining backfill material placed behind the wall, each module including at least one connector element anchored therein and extending outwardly from a back surface of the module;

(b) a plurality of wire mesh panels extending rearwardly from the wall into an interior of the backfill material, each wire mesh panel defining an interior end and an exterior end and including a plurality of lengthwise extending wires having apertures formed at the exterior ends; and (c) a plurality of elongate connection means for adjustably connecting the wire mesh panels to the modules by engaging one or more selected connector elements at one end of the connection means and by engaging the apertures of one or more selected wire mesh panels at another end of the connection means, each connection means being adjustable horizontally, vertically and in length relative to the wall and including:

(i) a two-part housing comprising a first cylindrical housing defining an open end and a closed end, and a second spaced-apart cylindrical housing defining an open end and a closed end;

(ii) an elongate coil bolt with an adjustable nut element in a medial portion thereof and defining a right hand coil thread on one side of the nut element and a left hand coil thread on the other side of the nut element, the elongate coil bolt extending into the open end of the first cylindrical housing at one end thereof and into the open end of the second cylindrical housing at the other end thereof;

(iii) a right hand coil nut mounted in said first cylindrical housing for threadably receiving the right hand coil thread of the elongate coil bolt and a left hand coil nut mounted in the second cylindrical housing for threadably receiving the left hand coil thread of the elongate coil bolt; and (iv) an aperture defined at each opposing end of the two-part housing.

18. A retained earth structure comprising:

(a) an upright retaining wall formed from a plurality of interlocked modules for retaining backfill material disposed behind the wall, each module including a plurality of U-shaped devises anchored therein, each clevis having a pair of parallel legs extending outwardly from a back surface of the module, and each leg defining an aperture at an end of the clevis;

(b) a plurality of elongated wire mesh panels extending rearwardly from the wall into an interior region of the backfill material, the wire mesh panels each defining an interior end and an exterior end and each comprising a plurality of spaced widthwise wires and spaced lengthwise wires, the lengthwise wires having a plurality of apertures formed at the exterior ends; and (c) a plurality of elongate adjustable connection means for adjustably connecting the wire mesh panels to the facing modules, each connection means having a first end and a second end, each connection means engaging one or more selected devises of each module at the first end of the connection means with an elongate connection pin extending through the apertures of the legs of the clevises, each connection means engaging the apertures of one or more selected wire mesh panels at the second end of the connection means, and each connection means being adjustable horizontally, vertically and in length relative to the wall.

19. A retained earth structure comprising:

(a) an upright retaining wall formed from a plurality of interlocked facing modules for retaining backfill material placed behind said wall, said facing modules each comprising at least one connector element anchored therein extending outwardly from the back surface of said module;

(b) a plurality of elongated wire mesh panels which extend rearwardly from said wall into the interior of said backfill material, said wire mesh panels each defining an interior end and an exterior end and each comprising a plurality of spaced widthwise wires and spaced lengthwise wires, the lengthwise wires having a plurality of apertures formed at the exterior ends thereof; and (c) a plurality of elongate adjustable connection means for adjustably connecting said wire mesh panels to said interlocked facing modules by engaging one or more selected connector elements of a facing module at one end thereof and one or more selected wire apertures of a wire mesh panel at the other end thereof, said adjustable connection means each being adjustable horizontally, vertically, and in length relative to said upright retaining wall, and said adjustable connection means including:

(i) a two-part housing comprising a first cylindrical housing defining an open end and a closed end, and a second spaced-apart cylindrical housing defining an open end and a closed end;

(ii) an elongate coil bolt with a nut element in the medial portion thereof and defining a right hand coil thread on one side of said nut element and a left hand coil thread on the other side of said nut element, said elongate coil bolt extending into the open end of said first cylindrical housing at one end thereof and into the open end of said second cylindrical housing at the other end thereof; and (iii) a right hand coil nut mounted in said first cylindrical housing for threadably receiving said right hand coil thread of said elongate coil bolt and a left hand coil nut mounted in said second cylindrical housing for threadably receiving said left hand coil thread of said elongate coil bolt.

20. A retained earth structure comprising:

(a) an upright retaining wall formed from a plurality of interlocked facing modules for retaining backfill material placed behind said wall, said facing modules each comprising at least one connector element anchored therein extending outwardly from the back surface of said module;

(b) a plurality of elongated wire mesh panels which extend rearwardly from said wall into the interior of said backfill material, said wire mesh panels each defining an interior end and an exterior end and each comprising a plurality of spaced widthwise wires and spaced lengthwise wires, the lengthwise wires having a plurality of apertures formed at the exterior ends thereof; and (c) a plurality of elongate adjustable connection means for adjustably connecting said wire mesh panels to said interlocked facing modules by engaging one or more selected connector elements of a facing module at one end thereof and one or more selected wire apertures of a wire mesh panel at the other end thereof, said adjustable connection means each being adjustable horizontally, vertically, and in length relative to said upright retaining wall, and said adjustable connection means including:

(i) a two-part housing comprising a first cylindrical housing defining an open end and a closed end, and a second spaced-apart cylindrical housing defining an open end and a closed end;

(ii) an elongate coil bolt with a nut element in the medial portion thereof and defining a right hand coil thread on one side of said nut element and a left hand coil thread on the other side of said nut element, said elongate coil bolt extending into the open end of said first cylindrical housing at one end thereof and into the open end of said second cylindrical housing at the other end thereof;

(iii) a right hand coil nut mounted in said first cylindrical housing for threadably receiving said right hand coil thread of said elongate coil bolt and a left hand coil nut mounted in said second cylindrical housing for threadably receiving said left hand coil thread of said elongate coil bolt; and (iv) an aperture at each opposing end of the connection means for engaging one or more facing module connector elements at one end and one or more mesh panel wire apertures at the other end.

21. A method for constructing a mechanically stabilized retaining wall utilizing precast concrete facing panels comprising the steps of:

(a) setting the facing panels in place beginning with the bottommost facing panels;

(b) attaching a plurality of spaced wire mesh panels to the back of the facing panels;

(c) embedding the plurality of wire mesh panels as soil is placed and compacted behind the facing panels;

(d) mounting a plurality of fastener elements to a back surface of the facing panels;

(e) providing a plurality of adjustable connector members each comprising:

(i) a two-part housing including a first cylindrical housing defining an open end and a closed end, and a second spaced-apart cylindrical housing defining an open end and a closed end;

(ii) an elongate coil bolt with a nut element adjustably disposed at a medial portion thereof and defining a right hand coil thread on one side of the nut element and a left hand coil thread on the other side of the nut element, the elongate coil bolt extending into the open end of the first cylindrical housing at one end thereof and into the open end of the second cylindrical housing at another end thereof; and (iii) a right hand coil nut mounted in the first cylindrical housing for threadably receiving the right hand coil thread of the elongate coil bolt and a left hand coil nut mounted in the second cylindrical housing for threadably receiving the left hand coil thread of the elongate coil bolt; and (f) interconnecting each wire mesh panel to each facing panel by connecting one end of each connector member to the fastener element of each facing panel and another end of each connector member to and outer end of each wire mesh panel, whereby the connector members are adjustable horizontally, vertically and in length relative to the retaining wall.

* * * * *

UNITED STATES PATENT AND TRADEMARK OFFICE

CERTIFICATE OF CORRECTION

PATENT NO. : 5,971,669
DATED : October 26, 1999
INVENTOR(S) : Crigler

It is certified that error appears in the above-indentified patent and that said Letters Patent is hereby corrected as shown below:

In both the Title and at the beginning of Column One (1), please delete "MECHNICALLY" and insert --MECHANICALLY--.

Signed and Sealed this

Sixteenth Day of May, 2000

*Attest:*

Q. TODD DICKINSON

*Attesting Officer*

*Director of Patents and Trademarks*